US005787733A

United States Patent [19]

Volpi

[11] Patent Number: 5,787,733

[45] Date of Patent: Aug. 4, 1998

[54] TREATMENT MACHINE, IN PARTICULAR FOR TEXTILES, COMPRISING A REMOVABLE VAT AND A FIXED TERMINAL INSTALLATION

[75] Inventor: Sylvain Volpi, Landas, France

[73] Assignee: S.A. Etablissements C. Burel Corporation, Wattrelos, France

[21] Appl. No.: 728,690

[22] Filed: Oct. 10, 1996

[30] Foreign Application Priority Data

Oct. 30, 1995 [FR] France ..... 95 13048

[51] Int. Cl.[6] ..... D06B 3/10; D06B 3/36; D06B 23/00

[52] U.S. Cl. ..... 68/12.07; 68/177; 68/184

[58] Field of Search ..... 68/12.07, 150, 68/177, 178, 184, 189; 134/169 R, 169 A

[56] References Cited

U.S. PATENT DOCUMENTS

| | | | |
|---|---|---|---|
| 3,233,435 | 2/1966 | Maynard | 68/177 X |
| 3,751,946 | 8/1973 | Claiborne | 68/12.07 |
| 3,826,112 | 7/1974 | Sick | 68/150 X |
| 4,656,846 | 4/1987 | Damm | 68/177 X |

FOREIGN PATENT DOCUMENTS

| | | | |
|---|---|---|---|
| 0 126 042 | 11/1984 | European Pat. Off. | D06B 3/28 |
| 2 691 722 | 12/1993 | France | D06B 23/24 |
| 43 05 438 | 5/1995 | Germany | D06B 23/24 |
| 1214588 | 12/1970 | United Kingdom | 68/177 |

OTHER PUBLICATIONS

French Search Report issued for French application No. 95 13048.

*Primary Examiner*—Philip R. Coe
*Attorney, Agent, or Firm*—Wolf, Greenfield & Sacks, P.C.

[57] ABSTRACT

A removable treatment vat is connectable via a quick-release coupler to a fixed installation including a control unit together with a fluid monitor and a fluid driver for driving treatment fluid(s), said fluid driver being suitable for causing the fluid(s) to circulate under given conditions of flow rate, pressure, and temperature, from a fluid inlet to the coupler to the vat. The fluid driver includes a fluid circuit and a circulation pump; the control unit includes an electronic control circuit suitable for running the treatment process as a function of data coming from the above-mentioned fluid monitor and data specific to the vat, and possibly also data specific to the treatment proper.

20 Claims, 2 Drawing Sheets

TREATMENT MACHINE, IN PARTICULAR FOR TEXTILES, COMPRISING A REMOVABLE VAT AND A FIXED TERMINAL INSTALLATION

The present invention relates to a treatment machine in which one or more treatment fluids is/are caused to circulate under predetermined conditions, in particular of time and of temperature. The present invention relates particularly to a textile treatment machine in which a textile material is put into contact with a treatment bath, e.g. a bath of dye. It may comprise, in particular, a so-called "beck" machine in which the textile material to be treated is present in the form of an endless loop which moves continuously through the treatment bath under drive from a displacement member generally referred to as a winch.

BACKGROUND OF THE INVENTION

Any treatment machine includes a vat, means for feeding and removing treatment fluid, means for raising or lowering the temperature thereof, optional means for circulating the treatment fluid inside the vat, monitoring means, and general control means for the machine. More particularly, in the case of a textile treatment machine in which material is displaced, such a machine also includes a displacement member driven by any appropriate means. It should be observed that all of the above-mentioned means relating to the treatment fluid are located at the periphery of the vat and occupy an ever increasing amount of room representing the most expensive portion of the machine.

In general, the treatment vat constitutes the main body of the machine, and all the other means are either contained within the vat proper, or else are disposed on the periphery thereof so as to enable the machine to operate appropriately as a function of the intended application.

According to the Applicant, the above known structure of treatment machines suffers from the major drawback of being unsuitable for being readily adapted as a function of parameters applicable to each treatment. For example, in textile treatment, the capacity of the treatment vat determines the volume of material that can be treated in the machine. A textile finisher therefore needs to have a considerable collection of treatment machines in order to be able to satisfy demand effectively. This problem becomes worse when the finisher needs to treat a very wide variety of batches of material.

When the quantity of material to be treated is considerably smaller than the normal capacity of the machine, the finisher needs to use a longer bath ratio with the consequential technical risks that that entails, in addition to the treatment being of increased cost.

Another drawback observed by the Applicant consists in the non-negligible amount of time taken up in any treatment during which the treatment machine is not performing its main function, i.e. time during which it is, so to speak, underemployed. For textile treatment this relates particularly to loading time during which the textile material is put into place inside the vat, and also unloading time during which the material is taken out from the vat. This time, which is not genuinely productive in terms of treatment, can constitute a large fraction of the total time required for implementing the treatment process.

OBJECT AND SUMMARY OF THE INVENTION

The object of the Applicant is to propose a treatment machine that mitigates the above-specified drawbacks.

This object is achieved by the treatment machine of the invention in which a removable treatment vat is connectable via quick-coupling means to a fixed terminal installation including at least general control means together with monitoring means and fluid drive means for driving treatment fluid(s), said fluid drive means being suitable for causing said fluid(s) to circulate under given conditions of flow rate, pressure, and temperature, from a fluid inlet to the means for coupling to the vat.

Thus, all of the main members which in conventional machines are generally situated at the periphery of the treatment vat are, according to the concept of the invention, grouped together in a fixed terminal installation which is organized in such a manner that the quick-coupling means enable a removable treatment vat to be connected thereto. It will be understood that to a given fixed terminal installation does not need to be connected always the same vat, but can be connected a variety of vats, and in particular vats of different capacities.

This particular disposition makes it possible to select the vat which is most appropriate as a function of the treatment to be performed, and in particular as a function of the size of the batch to be treated. Also, it becomes possible to perform operations other than the treatment proper, for example loading and unloading the materials to be treated, at locations where the treatment vat is not connected to the terminal installation, which installation can then be in operation with another vat performing some other treatment. This optimizes operating time of the fixed terminal installation by enabling some operations to take place in parallel.

Advantageously, a single terminal installation has a plurality of quick-coupling means enabling it to be connected to a plurality of treatment vats simultaneously. Naturally, under such circumstances, the general control means are designed to run treatment processes in each of the vats concerned.

This particular embodiment provides a considerable saving in space over existing installations and also serves to reduce the overall cost of the machine since the same means for monitoring and driving the treatment fluid(s) are used for a plurality of treatment vats.

In the field of textile finishing, the fluid drive means contained in the fixed terminal installation comprise at least a fluid circuit and a circulation pump suitable for filling, circulating, and emptying the treatment fluid(s) and also for injecting additives therein; in addition, the monitoring means contained in the fixed terminal installation include, on the fluid circuit, means for monitoring the flow rate of the treatment bath, for monitoring the level of said bath in the vat, for monitoring its temperature, and for monitoring its pH; and finally the general control means comprise an electronic control circuit suitable for running the treatment process as a function of data coming from the various above-mentioned monitoring means and data specific to the vat and possibly also data specific to the treatment proper.

Preferably, the fluid drive means for driving the treatment fluid(s) also include at least one heat exchanger disposed on the fluid circuit between the fluid inlet and the circulation pump.

The monitoring means contained in the fixed terminal installation may optionally monitor the color of the bath circulating through the vat during treatment.

For a textile treatment machine in which the textile material is displaced in the form of an endless loop inside the vat by a displacement member driven by drive means, the invention provides for the displacement member located in the removable vat to be connectable by quick-coupling means to drive means which are located in the fixed terminal installation and controlled by the general control means. In this version, the treatment vat is not independent insofar as the textile material cannot be displaced inside said vat by the displacement member without being directly connected to the fixed terminal installation or to some other external drive system.

In a second version, the removable vat can be independent. Under such circumstances, the displacement member located in the removable vat is driven by drive means secured to said vat, while said drive means are themselves connectable to the general control means of the fixed installation. Under such circumstances, it is possible at some other location to perform operations in the removable vat other than the treatment operations proper which are under the control of the general control means of the fixed installation. These operations may be wringing-out type operations.

In particular, the textile treatment machine may be of the beck type in which the textile material is displaced by a member constituting an elliptical winch which is located above the level of the treatment bath inside the vat and which is suitable for causing the material to be displaced and for causing it to be put down in the form of a folds.

In a preferred version of a beck type textile treatment machine, the displacement member is in the form of a set of three deflector rollers, said set being driven with reciprocating motion suitable for forming folds.

Preferably, the treatment vat has a cover, with the central roller of the set of three deflector rollers being secured to the cover while the other two rollers that are further apart are secured to the vat proper. This particular disposition makes it easy to thread textile material through the set of three deflector rollers.

According to the invention, the vat is made removable by a set of wheels that may optionally be swivel-mounted. In addition, said vat includes at least one handle enabling it to be displaced relative to the fixed location of the terminal installation.

Advantageously, the treatment machine includes, in the vicinity of the terminal installation, guide rails for the wheels fitted to the removable vat, which rails enable the vat to be positioned accurately relative to the terminal installation while said two elements are being coupled together by the quick-coupling means.

BRIEF DESCRIPTION OF THE DRAWINGS

The present invention will be better understood on reading the following description of an embodiment of a beck-type textile treatment machine comprising a removable vat and a fixed terminal installation shown in the accompanying drawings, in which.

MORE DETAILED DESCRIPTION

Figure 1:
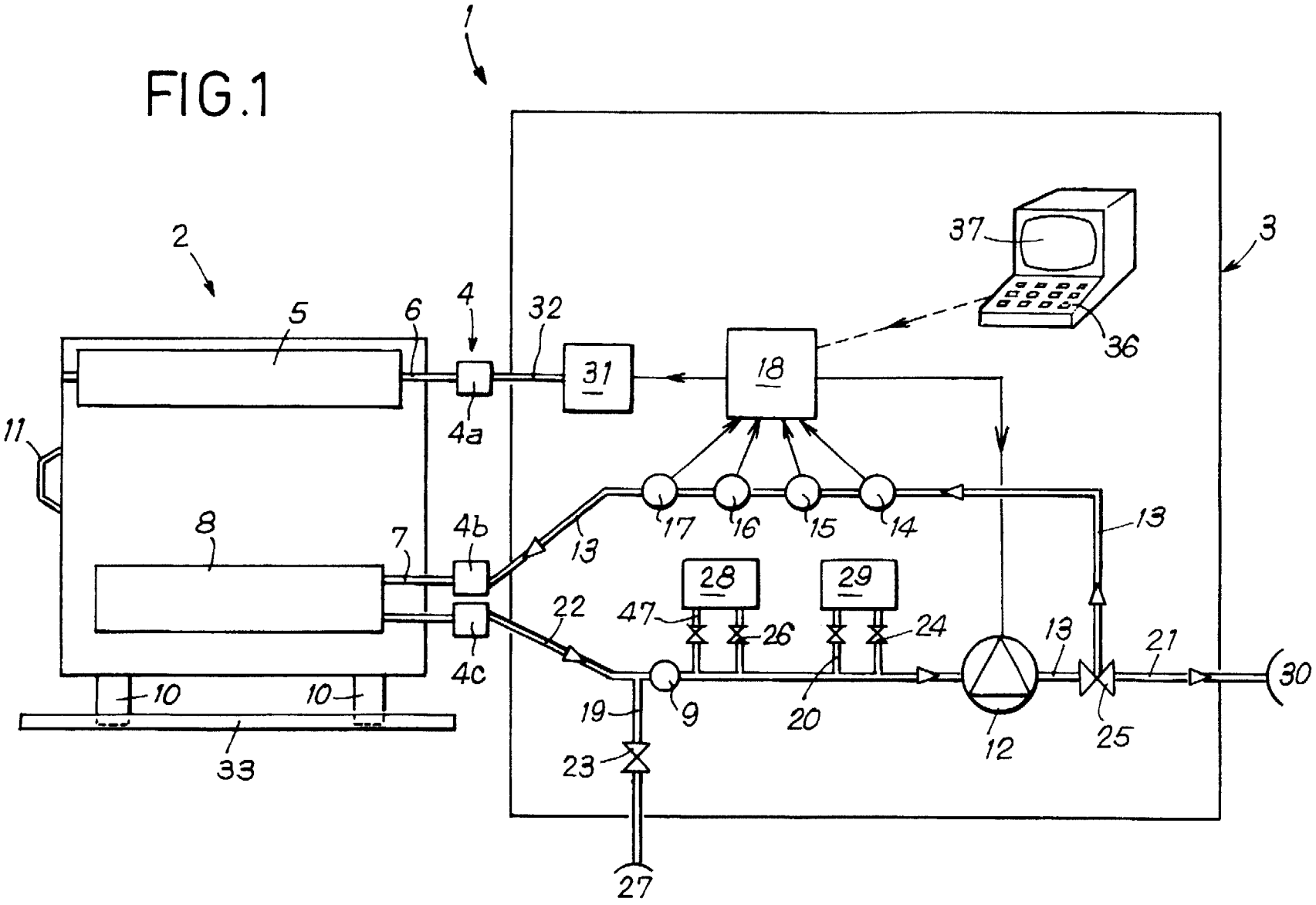
FIG. 1 is a diagrammatic representation of the various component parts of the machine.

The present invention relates to treatment machine which is made up of two main elements that are independent from each other and that are coupled together by quick-coupling means. FIG. 1 is a diagrammatic representation of the first main element which is a removable processing vat 2, of the second main element which is a fixed terminal installation 3, and of the various quick-coupling means 4, the assembly as a whole constituting the treatment machine 1 of the invention.

In the example described below in non-exhaustive manner, the machine 1 is a textile treatment machine intended in particular for dyeing and it is referred to as a "beck". In this machine 1, the vat 2 includes a member 5 for moving the material accumulated inside the vat in the form of a loop. This displacement member 5, commonly called a winch, is elliptical in shape so that when it rotates about the shaft 6 it serves to drive the textile material and to pile it up in the form of folds along the bottom wall of the vat 2 beneath said member 5.

The vat 2 includes means 8 for establishing internal circulation of the treatment bath, e.g. via spray manifolds.

The internal members of the treatment vat, namely the treatment member 5, the means 8 for establishing internal circulation of the treatment bath, and optionally any other appropriate member, all extend to the outside of the vat 2 in sealed manner via respective links suitable for co-operating with appropriate coupling means, respectively 4*a* for the drive member 5, and 4*b* and 4*c* for the inlet and outlet ducts 7 and 7' of the internal circulation means 8. The vat 2 is carried on wheels 10 and includes one or more handles 11 enabling an operator to move the removable vat 2 when said vat 2 is not connected to the fixed terminal installation 3 by the coupling means 4.

In the present specification, the term "terminal installation" 3 is used to designate a structure that is independent and fixed and that contains a plurality of members which extend to the outside thereof in such a manner as to be connectable to the treatment vat 2 by the quick-coupling means 4. For a textile beck, these members must feed and remove the treatment bath under appropriate conditions of flow rate, temperature, and pH, depending on the dyeing process; they can also drive the displacement member 5.

For circulating the treatment bath, the installation 3 contains a pump 12 that is preferably a reversible variable flow rate pump whose delivery channel is extended by a pipe 13 terminating outside the installation 3 at the coupling means 4*b*, and having an intake channel extended by a pipe 22 terminating outside the installation 3 at the coupling means 4*c*. Various monitoring systems are installed on the delivery pipe 13: temperature monitoring 14, pH monitoring 15, flow rate monitoring 16, and color monitoring 17. A level monitoring system 9 is installed on the intake pipe. Each of the monitoring systems 9, 14, 15, 16, and 17 is connected to an electronic control circuit 18 of the programmable controller, processor, or microprocessor type which receives data relating to the various parameters concerned: temperature, pH, flow rate, colorimetry, level.

In addition to the intake and delivery pipes 22 and 13, the fluid circuit includes a set of other pipes that may optionally lead to the outside of the fixed installation 3. A first pipe 19 provided with a valve 23 is connected to a source of fluid 27 and terminates in the intake pipe 22; two second pipes 20 provided with respective valves 24 connect a preparation vat 29 to the intake pipe 22; two third pipes 47 provided with respective valves 26 connect a heat exchanger 28 to the intake pipe 22; a fourth pipe 21 is connected to a drain 30 and terminates in the delivery pipe 13 via a three-port valve 25. All of the valves 23 to 26 are connected to the electronic control circuit 18.

The heat exchanger 28 is suitable for raising the fluid circulating in the intake pipe 22 to the appropriate temperature. Additives may also be injected either from the preparation vat 29 or from a branch on the intake pipe 22 so as to enable additive to be diluted using the presently circulating bath.

The fixed terminal installation 3 also includes a drive motor 31 suitable for rotating a shaft 32 which is capable of driving the displacement member 5 via the coupling means 4*a*. This motor 31 is itself connected to the electronic control circuit 18.

The fixed terminal installation 3 finally includes a keyboard 36 and a display screen 37 enabling the operator to input all appropriate information concerning the special features of the treatment to be performed. Firstly, these include parameters relating to the treatment vat 2 connected to the installation 3 since, according to the main characteristic of the invention, various different vats 2 can be connected to a single installation 3. The other parameters include mainly data relating to the material to be dyed and possibly the particular dyeing process that has been selected. Naturally, the circuit 38 has previously been programmed so as to be capable of running the dyeing process and the operating conditions of the vat 2 as a function of the data input from the keyboard 36 and also as a function of the data coming from the various monitoring systems 9 and 14 to 17. Control is performed by opening and closing the valves 23 to 26 of the various pipes, and by controlling the drive motor 31 so as to comply with the preprogrammed conditions entered into the electronic control circuit 18 for the selected treatment process.

It should be observed that the information relating to the treatment process may also be input into an external electronic circuit having all of the terminal installations of a workshop connected thereto. Under such circumstances, the keyboard 36 enables the operator to communicate with the internal circuit 18 which will initially have been loaded from the external circuit.

The same reversible pump 12 is advantageously used for all fluid drive operations concerning the treatment bath: filling, circulating, and emptying the bath in the vat 2. Naturally, it would also be possible to have a plurality of non-reversible pumps, including one serving for filling, and another for emptying.

The quick-coupling means 4 are designed to establish a proper junction between the vat 2 and the installation 3 without interfering with the operation of the interconnected members.

In order to make it easier for the operator to position the removable vat 2 properly relative to the fixed installation 3, guide rails 33 are placed on the ground close to the fixed terminal installation 3. All the operator then needs to do is position the vat 2 in such a manner that its wheels 10 are engaged against the guide rails 33 and then displace said vat 2 by means of the handle 11 or possibly by means of a displacement carriage, until the external portions of the members to be coupled together come into mutual contact at the various coupling means 4*a* to 4*c*, after which said coupling means 4 are actuated so as to establish the junction between the vat 2 and the installation 3.

Other means could be envisaged for guiding the vat 2, such as wire-guidance or guidance by means of converging slideways, forming a funnel for accurately positioning a pivoting caster wheel fixed beneath the vat.

Figure 2:
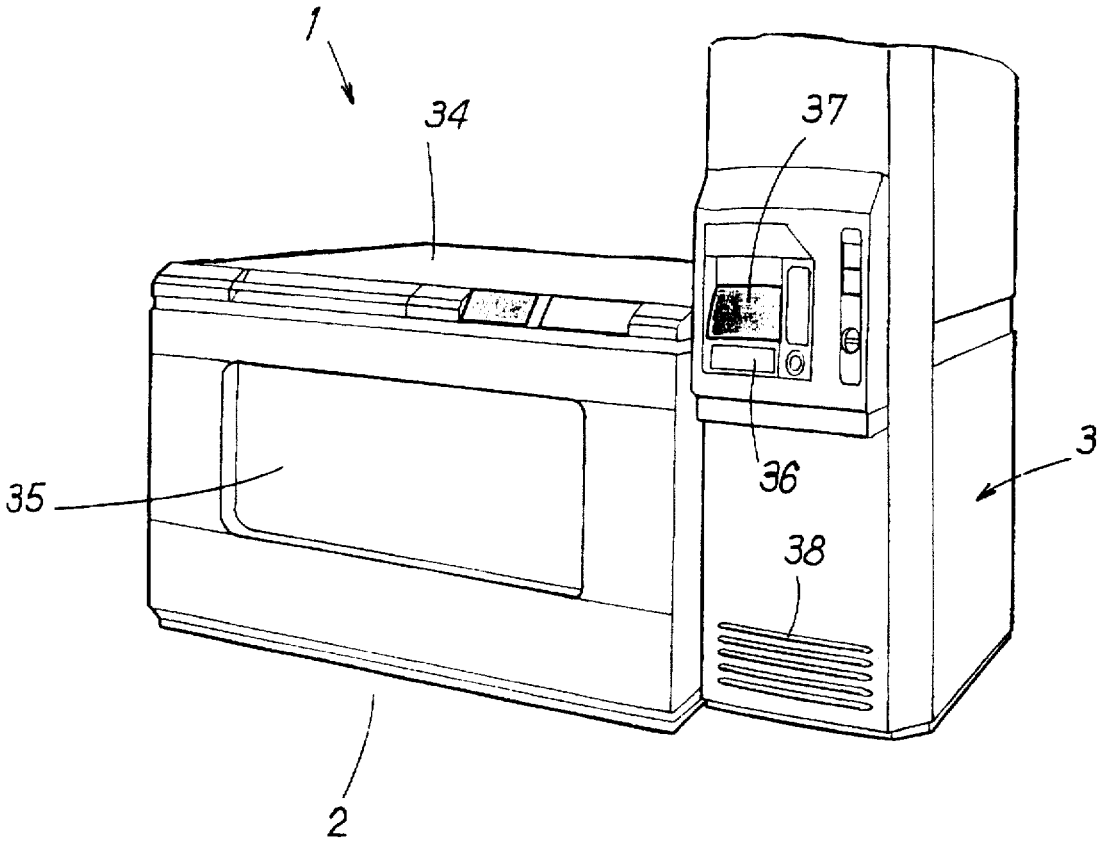
FIG. 2 is a perspective diagrammatic view of a dyeing beck comprising a removable vat and a fixed terminal installation.

In the view of FIG. 2, the treatment vat 2 includes a cover 34 that can be pivoted by a hydraulic actuator (not shown) and it includes a front window 35.

On the view of the fixed terminal installation 3 shown in FIG. 2, there can be seen the keyboard 36, the screen 37, and also air ventilation openings 38 enabling the installation 3 to be ventilated.

Figure 3:
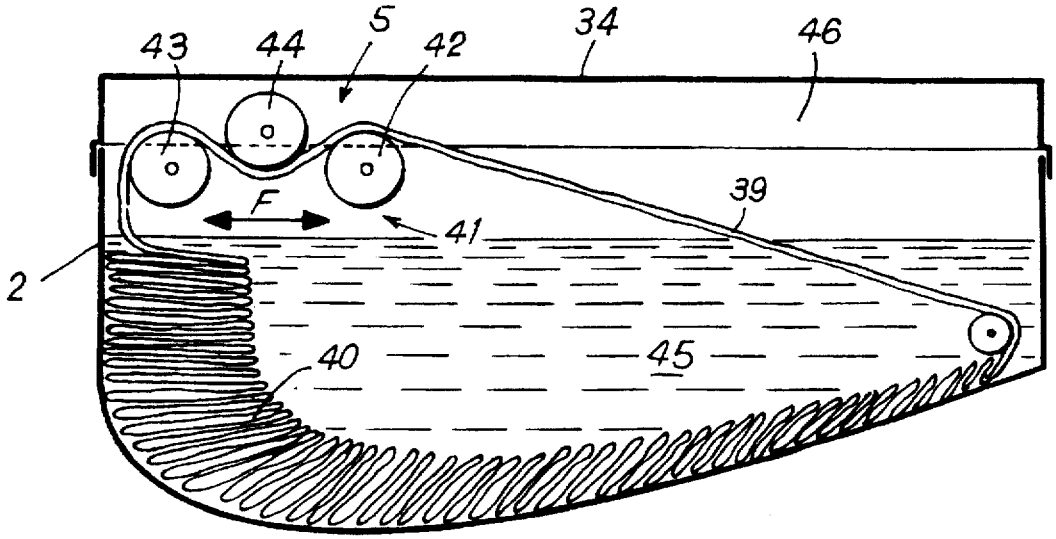
FIG. 3 is a diagrammatic section view through the set of rollers for driving the textile material through the beck shown in FIG. 2.

Compared with a conventional dyeing beck, the beck shown in FIG. 3 has a member 5 for displacing the textile material 39 and for forming folds 40 which is not in the traditional form of an elliptical-section winch. This displacement member 5 comprises a set 41 of three deflector rollers, comprising respectively an upstream roller 42, a downstream roller 43, and an intermediate roller 44. These three rollers are rotated with the same peripheral speed and they are disposed in such a manner as to form variable-tension rollers through which the textile material follows a S-shaped path, coming necessarily into contact with an angular fraction of each of the rollers. The outside surface of each roller 42, 43, and 44 has a coefficient of friction that is sufficient to ensure that when the textile material 39 is pressed against said surface then the material is driven thereby without slip.

The set 41 of three deflector rollers is driven backwards and forwards with reciprocating motion as shown by double-headed arrow F, with the amplitude of said motion determining the width of the folds 40 formed in the bath 45.

The intermediate deflector roller 44 is preferably secured to the cover 34 while the other two deflector rollers 42 and 43 upstream and downstream therefrom are secured to the treatment vat 2 proper. This disposition makes it easier to load textile material 39 inside the vat 2 since all the operator needs to do is install a loop of said material with a length of the material passing over the upstream and downstream rollers 42 and 43. When the cover 34 is closed, the intermediate roller 44 takes up exactly the right position over the length of material 39 extending between the upstream and downstream rollers 42 and 43.

According to the Applicant, driving the textile material 39 by means of the set 41 of deflector rollers provides several advantages. Firstly, compared with an elliptical-section winch, it is possible to minimize the space required above the bath of dye 45 for housing the member 5. Thus, the volume of air 46 located above the bath of dye 45 is smaller in the vat 2 shown in FIG. 3 than it is in a conventional beck. Also, an elliptical-section winch can generate folds of a given width only, whereas in the present case, it is possible to adjust the reciprocating replacement stroke of the deflector set 41 to vary the width of the folds 40 at will. Finally, because the contact surfaces of the three rollers 42, 43, and 44 press against both faces of the textile material 39, it is possible to achieve displacement of the textile material 39 without slip and thus without jerking. This set 41 of deflector rollers operating with reciprocating transverse displacement can also be used in traditional becks, as a replacement for an elliptical-section winch.

The present invention is not limited to the embodiment described above as a non-exhaustive example. In particular, the fixed terminal installation 3 may be designed to be connected to a plurality of treatment vats 2 and to drive them simultaneously. For example, if a terminal installation 3 is suitable for connection to two vats, the two vats may be located in parallel with each other and on opposite sides of the terminal installation. Other dispositions are also possible, in particular a T-shaped configuration, or a star-shaped configuration.

Under such circumstances, provision may be made for the same treatment bath to flow simultaneously through both vats connected to the same terminal installation. This particular disposition has the advantage of ensuring that the treatment performed in both vats is indeed identical. The same advantage can also be obtained with two machines of the invention whose internal control circuits are connected together or to a common external electronic control circuit.

One of the internal circuits runs the operations while the other merely relays them unchanged or possibly corrects for possible differences.

Also, although the treatment machine of the invention is particularly suitable for use in the field of textile finishing, and in particular in beck type machines, this does not exclude other applications, or fields other than textiles.

I claim:

1. A machine for treating material under the action of treatment fluid(s) in which a removable treatment vat is connectable via quick-coupling means to a fixed installation including at least fluid drive means for making said fluid(s) circulate under given conditions of flow rate, pressure, and temperature, from a fluid inlet to the quick coupling means, monitoring means for monitoring the flow rate, pressure and temperature of said treatment fluid(s), and control means for running said drive means as a function at least of data coming from said monitoring means.

2. A machine according to claim 1, wherein a single installation includes a plurality of quick-coupling means enabling it to be connected to a plurality of treatment vats simultaneously.

3. A machine according to claim 1, wherein the fluid drive means includes at least a fluid circuit and a circulation pump for filling, circulating, and emptying the treatment fluid(s) and for injecting additives therein, wherein the monitoring means includes means for monitoring the flow rate of a treatment bath, for monitoring the level of said bath in the vat, for monitoring its temperature, and for monitoring its pH, and wherein the control means includes an electronic control circuit for running the treatment process as a function of data coming from the monitoring means and data specific to the vat.

4. A machine according to claim 3, wherein the monitoring means includes colorimetry means for monitoring the color of the bath flowing in one of an intake pipe and a delivery pipe of the pump.

5. A machine according to claim 3, in which the textile material is displaced in the form of an endless loop inside the vat by a displacement member driven by drive means, wherein the displacement member is located in the removable vat and is connectable to the drive means, and wherein the drive means is located in the fixed installation and is controlled by the control means.

6. A machine according to claim 3, in which the textile material is displaced in the form of an endless loop inside the vat by means of a displacement member driven by drive means secured to said vat, wherein the displacement member is located in the removable vat and is driven by the drive means, with said drive means being connectable to the control means of the fixed installation.

7. A machine according to claim 3, in which the textile material is displaced inside the vat by a displacement member and wherein the displacement member includes a set of three deflector rollers, said set of three deflector rollers being driven with reciprocating motion suitable for forming folds.

8. A machine according to claim 7, wherein the treatment vat has a cover, the central roller of the set of three deflector rollers being secured to the cover while the upstream and downstream rollers are secured to the vat proper.

9. A machine according to claim 1, wherein the vat is made removable by means of a plurality of wheels, and wherein the vat includes at least one handle enabling it to be moved relative to a fixed location of the installation.

10. A machine according to claim 9, including guide rails in the proximity of the installation for guiding the plurality of wheels fitted to the removable vat, said rails enabling the vat to be positioned accurately relative to the installation while said vat and installation are being connected together by the quick-coupling means.

11. A machine for treating material under the action of treatment fluid(s), comprising:

at least one vat;

a fluid driver including a pump and a fluid flow circuit;

at least one quick-release coupler adapted to releasably interconnect the at least one vat and the fluid flow circuit to permit the fluid flow circuit to communicate with the vat;

a fluid monitor, coupled to the fluid driver, arranged to monitor at least one of flow-rate, pressure and temperature of the fluid(s) and to produce information indicative thereof; and a control unit, coupled to the fluid monitor and the fluid driver, arranged to control the fluid driver responsive to the information from the fluid monitor, thereby controlling the at least one of the flow rate, pressure and temperature of the fluid(s).

12. The machine as claimed in claim 11, wherein the fluid driver includes a heat exchanger disposed on the fluid flow circuit.

13. The machine as claimed in claim 11, wherein:

the fluid monitor is arranged to monitor each of the flow-rate, pressure and temperature of the fluid(s); and the control unit is arranged to control each of the flow rate, pressure and temperature of the fluid(s) responsive to the information from the fluid monitor.

14. The machine as claimed in claim 11, wherein the fluid driver is adapted to fill the at least one vat with the fluid(s), circulate the fluid(s) within the at least one vat, and empty the fluid(s) from the at least one vat.

15. The machine as claimed in claim 14, wherein the fluid driver is adapted to inject additives into the fluid(s).

16. A fluid circulator for use with a treatment machine that treats materials under the action of treatment fluid(s), comprising:

a fluid driver including a pump and a fluid flow circuit;

at least one quick-release coupler adapted to releasably interconnect the fluid flow circuit and at least one vat to permit the fluid flow circuit to communicate with the at least one vat;

a fluid monitor, coupled to the fluid driver, arranged to monitor at least one of flow-rate, pressure and temperature of the fluid(s) and to produce information indicative thereof; and a control unit, coupled to the fluid monitor and the fluid driver, arranged to control the fluid driver responsive to the information from the fluid monitor, thereby controlling the at least one of the flow rate, pressure and temperature of the fluid(s).

17. The fluid circulator as claimed in claim 16, wherein the fluid driver includes a heat exchanger disposed on the fluid flow circuit.

18. The fluid circulator as claimed in claim 16, wherein:

the fluid monitor is arranged to monitor each of the flow-rate, pressure and temperature of the fluid(s); and the control unit is arranged to control each of the flow rate, pressure and temperature of the fluid(s) responsive to the information from the fluid monitor.

19. The fluid circulator as claimed in claim 16, wherein the fluid driver is adapted to fill the at least one vat with the fluid(s), circulate the fluid(s) within the at least one vat, and empty the fluid(s) from the at least one vat.

20. The fluid circulator as claimed in claim 19, wherein the fluid driver is adapted to inject additives into the fluid(s).

* * * * *